US008505114B1

(12) United States Patent
Earley

(10) Patent No.: US 8,505,114 B1
(45) Date of Patent: Aug. 13, 2013

(54) GARMENT ATTACHABLE RETENTION SYSTEM

(76) Inventor: Austin Earley, Brookings, SD (US)

( * ) Notice: Subject to any disclaimer, the term of this patent is extended or adjusted under 35 U.S.C. 154(b) by 465 days.

(21) Appl. No.: 12/706,443

(22) Filed: Feb. 16, 2010

(51) Int. Cl.
*A41D 1/00* (2006.01)
*A41D 3/02* (2006.01)

(52) U.S. Cl.
USPC ..... 2/94; 2/101

(58) Field of Classification Search
USPC ..... 2/94, 69, 101, 247, 249, 250, 114
See application file for complete search history.

(56) References Cited

U.S. PATENT DOCUMENTS

| | | | | |
|---|---|---|---|---|
| 3,019,459 | A * | 2/1962 | Ripley | 441/107 |
| 4,877,167 | A | 10/1989 | McNemar | |
| 5,603,646 | A * | 2/1997 | Tobias | 441/94 |
| 5,640,922 | A | 6/1997 | Feldkamp | |
| 5,806,732 | A | 9/1998 | Hensley | |
| 5,829,060 | A * | 11/1998 | Falk et al. | 2/102 |
| 6,231,418 | B1 | 5/2001 | Hancock | |
| 6,405,376 | B1 * | 6/2002 | Falk et al. | 2/94 |
| 6,447,353 | B1 * | 9/2002 | Henry | 441/106 |
| 6,477,710 | B1 * | 11/2002 | Ojoyeyi | 2/69 |
| RE38,497 | E * | 4/2004 | Falk et al. | 2/94 |
| 6,763,527 | B1 * | 7/2004 | Rivoli et al. | 2/250 |
| 7,037,167 | B2 | 5/2006 | Primos | |
| 7,103,493 | B2 * | 9/2006 | Kang et al. | 702/117 |
| 7,387,225 | B2 | 6/2008 | Fox | |
| 2003/0126668 | A1 * | 7/2003 | Scroggins | 2/114 |
| 2005/0148280 | A1 | 7/2005 | Primos | |
| 2005/0210562 | A1 * | 9/2005 | Johnson et al. | 2/159 |
| 2008/0251553 | A1 | 10/2008 | Goldstone | |

* cited by examiner

*Primary Examiner* — Amber Anderson
(74) *Attorney, Agent, or Firm* — Neustel Law Offices

(57) ABSTRACT

A garment attachable retention system for securing a device, such as game call, dog whistle, training device, protection devices, sharpeners, clippers, lights, work tools, other electronic devices, other hunting or fishing devices, and etc. to a garment in a retractable manner. The retention system generally includes a garment, a substantially sealed first pocket secured to the garment, a retracting mechanism positioned within the first pocket and having an elongated member retractably connected thereto, and a device connected to the elongated member and adapted to retractably extend from the retracting mechanism via the elongated member. The first pocket may be located along an exterior surface of an interior surface of the garment. Various types of garments may be utilized, such as a coat, vest, pants, waders, suspenders, hat, cap, shirt, face masks, gloves, etc. In addition, a heating pad may be utilized to keep the device warm during non use.

15 Claims, 8 Drawing Sheets

GARMENT ATTACHABLE RETENTION SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a retention system for a device and more specifically it relates to a garment attachable retention system for efficiently securing a device, such as game call, dog whistle, training device, etc., to a garment in a retractable manner.

2. Description of the Related Art

Any discussion of the related art throughout the specification should in no way be considered as an admission that such related art is widely known or forms part of common general knowledge in the field.

Game calls and training devices have been in use for years. Typically, the game call or other device is suspended by a lanyard around the neck or body of the user. Often times, many game calls or devices are utilized which can lead to the lanyards becoming tangled, snagged, etc. By dangling the devices from the user, the devices can also become easily filled with dirt, water, etc. Because of the inherent problems with the related art, there is a need for a new and improved garment attachable retention system for efficiently securing a device, such as game call, dog whistle, training device, etc., to a garment in a retractable manner.

BRIEF SUMMARY OF THE INVENTION

A system for efficiently securing a device, such as game call, dog whistle, training device, etc., to a garment in a retractable manner. The invention generally relates to a retention system for a device which includes a garment, a substantially sealed first pocket secured to the garment, a retracting mechanism positioned within the first pocket, wherein the retracting mechanism has an elongated member having a first end connected to the retracting mechanism, and a device connected to a second end of the elongated member, wherein the device is adapted to retractably extend from the retracting mechanism via the elongated member. The first pocket may be located along an exterior surface of an interior surface of the garment. Various types of garments may be utilized, such as a coat, vest, pants, waders, suspenders, hat, cap, shirt. In addition, a heating pad may be utilized to keep the device warm during non use.

There has thus been outlined, rather broadly, some of the features of the invention in order that the detailed description thereof may be better understood, and in order that the present contribution to the art may be better appreciated. There are additional features of the invention that will be described hereinafter and that will faun the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
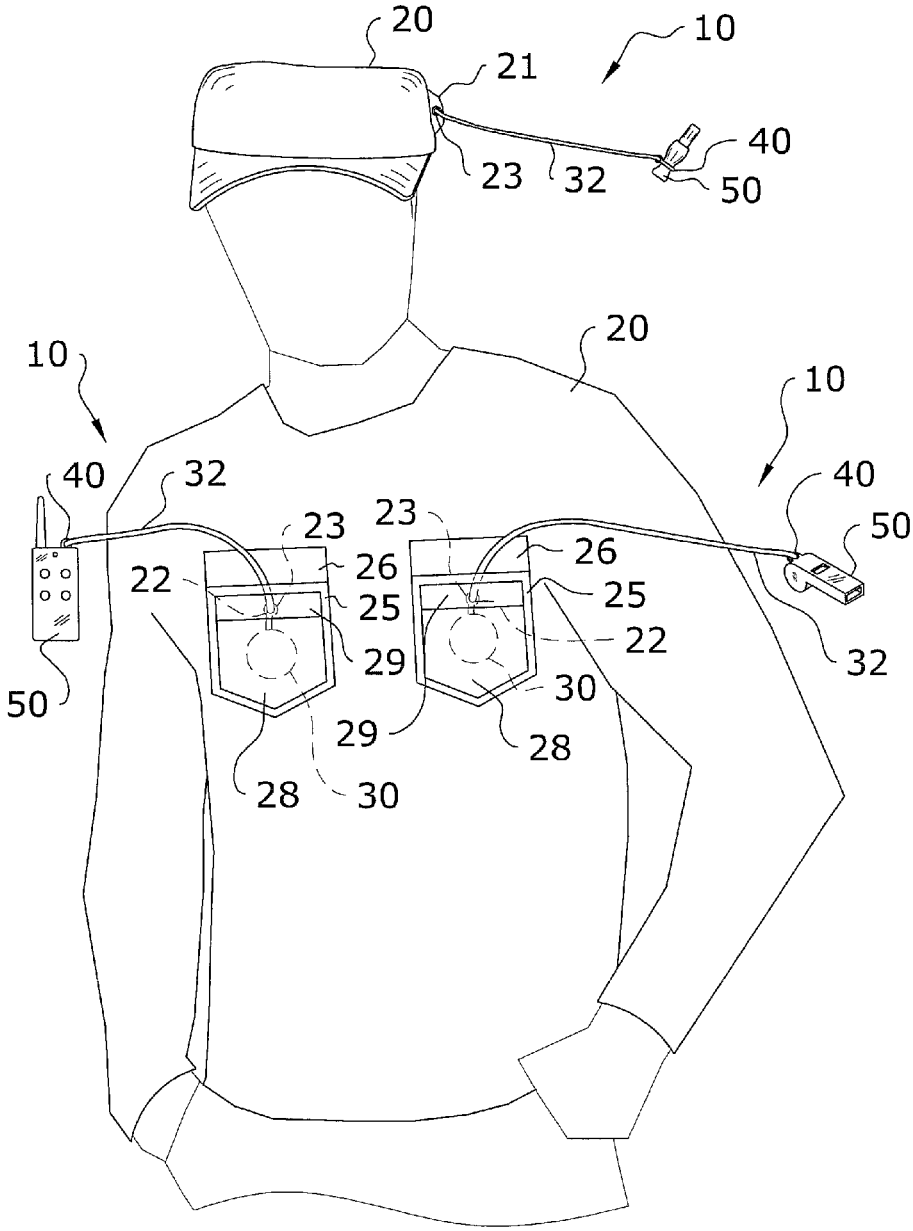
FIG. 1 is an exemplary view of the present invention in the extended position.

Turning now descriptively to the drawings, in which similar reference characters denote similar elements throughout the several views, FIGS. 1 through 8 illustrate a garment attachable retention system 10, which comprises a garment 20, a substantially sealed first pocket 21 secured to the garment 20, a retracting mechanism 30 positioned within the first pocket 21, wherein the retracting mechanism 30 has an elongated member 32 having a first end connected to the retracting mechanism 30, and a device 50 connected to a second end of the elongated member 32, wherein the device 50 is adapted to retractably extend from the retracting mechanism 30 via the elongated member 32. The first pocket 21 may be located along an exterior surface of an interior surface of the garment 20. Various types of garments 20 may be utilized, such as a coat, vest, pants, waders, suspenders, hat, cap, shirt. In addition, a heating pad 60 may be utilized to keep the device 50 warm during non use.

B. Garment

Various types of garments 20 may be utilized with the present invention, some of those which are illustrated and some of which are not shown. Generally, any garment 20 comprising an article of clothing could utilize the present invention. Preferably the garment 20 is a type that is worn as an outer layer while in an outdoors setting, such as a coat, vest, pants, waders, suspenders, hat, cap, shirt, face masks, gloves, etc. The pockets holding the retracting mechanism 30, device 50, and heating pad 60 may be attached to any location upon the garment 20, wherein the location is generally relatively accessible by the wearer.

The first pocket 21 is generally sewn or attached in another manner around a peripheral edge of the pocket 21 to the garment 20 to hold the retracting mechanism 30 securely therein. The first pocket 21 is preferably attached in such a manner that the retracting mechanism 30 will not slide out of the first pocket 21 and is generally not removable from the first pocket 21. It is appreciated however that the first pocket 21 may be configured to be opened in the case that the retracting mechanism 30 needs to be accessed.

Figure 5:
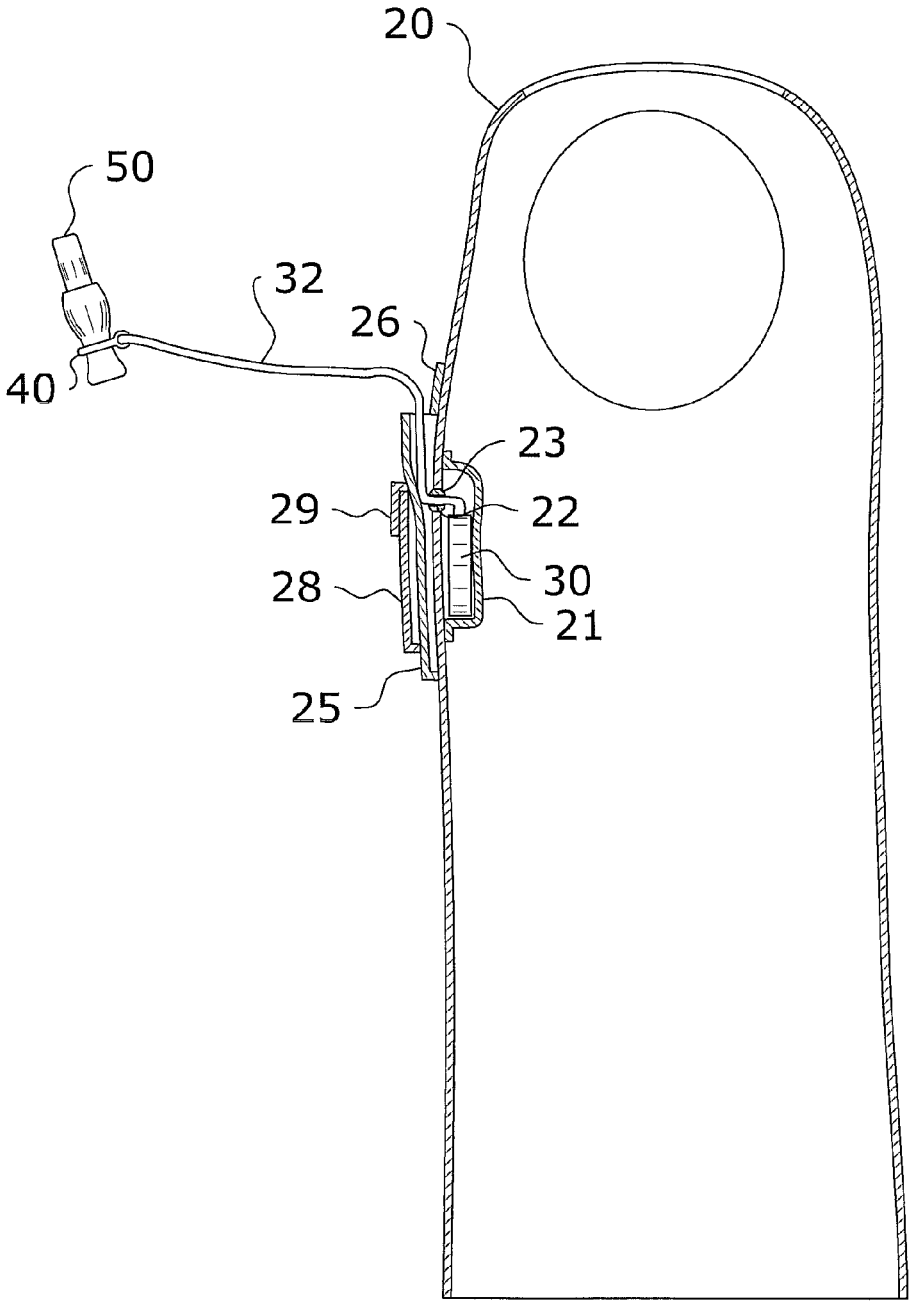
FIG. 5 is a sectional view of the present invention with the first pocket sewn to the inside surface of the garment and the device in the extended position.
Figure 6:
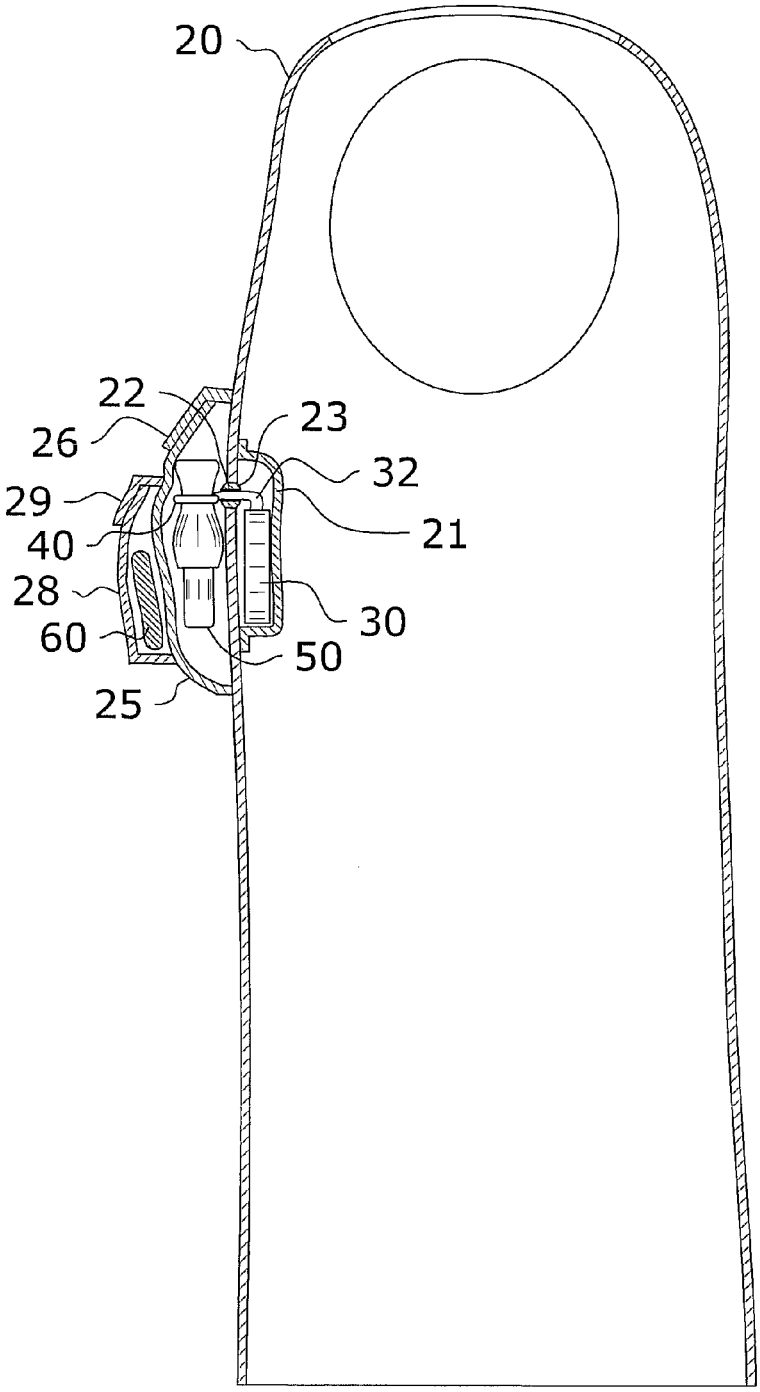
FIG. 6 is a sectional view of the present invention with the first pocket sewn to the inside surface of the garment and the device in the retracted position.
Figure 7:
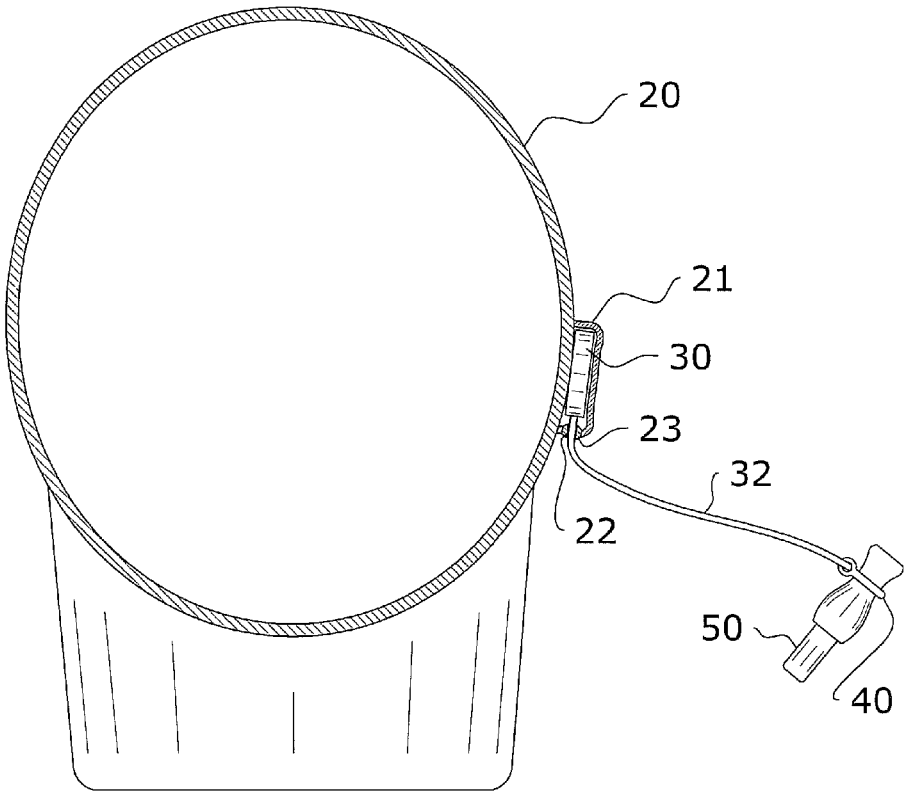
FIG. 7 is a sectional view of the present invention with the first pocket sewn to the outside surface of the garment and the device in the extended position.
Figure 8:
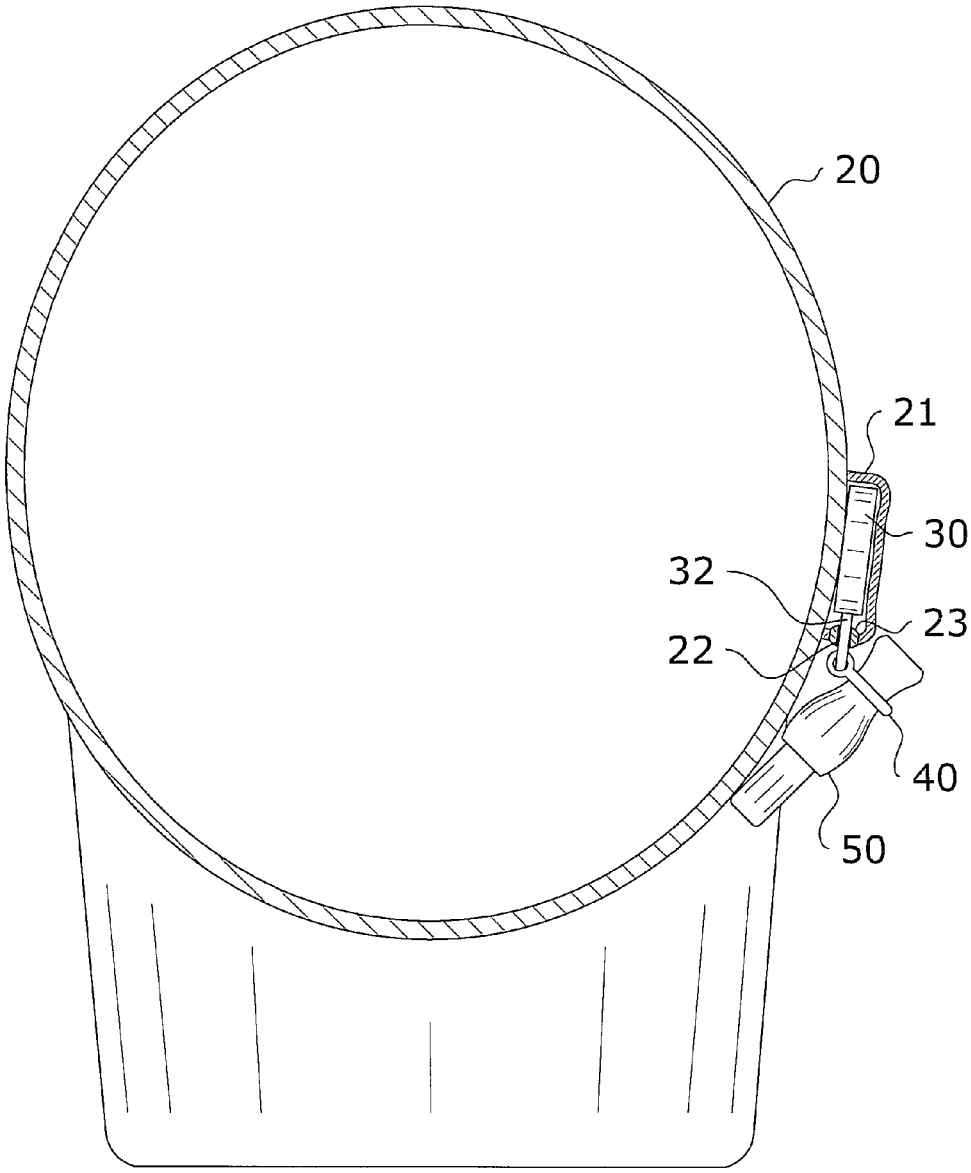
FIG. 8 is a sectional view of the present invention with the first pocket sewn to the outside surface of the garment and the device in the retracted position.

The first pocket 21 may be sewn or attached to the external side of the garment 20 or the internal side of the garment 20. When the garment 20 is worn in cold or freezing temperatures, the first pocket 21 is preferably sewn to the internal side of the garment 20 so that the first pocket 21 is positioned along an inside surface of the garment 20 adjacent the individual as illustrated in FIGS. 5 and 6. In situations, where there is not adequate space to secure the first pocket 21 to the inside surface of the garment 20, the first pocket 21 may be secured to the outside surface of the garment 20, such as but not limited to when utilizing a hat, cap, or suspenders as the garment 20 as illustrated in FIGS. 7 and 8. Positioning the first pocket 21 on the inside may also help with preventing snags upon the first pocket 21.

A first opening 22 connects the interior of the first pocket 21 to the exterior side of the garment 20. The first opening 22 may extend through the garment 20, such as when the pocket is sewn to the inside surface of the garment 20 or may extend through the first pocket 21, such as when the first pocket 21 is sewn to the exterior surface of the garment 20.

The opening 22 has a tubular guide 23 lining a perimeter in which the elongated member 32 from the retracting mechanism 30 passes therethrough. The guide 23 helps to ensure smooth passage of the elongated member 32 through the opening 22. The guide 23 may be integral with the garment 20 or may be comprised of a separate rubber, metal, plastic, or other type of piece.

A second pocket 25 is also generally located along the outside surface of the garment 20. The second pocket 25 may be previously apart of the garment 20 or may be separately attached thereto. The top of the second pocket 25 is preferably located adjacent and slightly above the opening 22 leading from the first pocket 21 so that the device 50 will retract directly within the second pocket 25 and none or substantially none of the elongated member 32 will be visible from an outside of the garment 20. The opening 22 thus extends within the second pocket 25. The second pocket 25 is generally for positioning the device 50 therein during non use to prevent the device 50 from becoming wet or dirty from outside elements.

The second pocket 25 may be attached to the same garment 20 as the first pocket 21 or may be attached to a different adjacent garment 20 as appreciate. The second pocket 25 also generally includes a closure portion 26, such as flap and/or button for closing the second pocket 25 when the device 50 is positioned therein to further keep foreign elements away from the device 50. The closure portion 26 may also assist in retaining the device 50 within second pocket 25 when being retracted.

A third pocket 28 is also generally located along the outside surface of the garment 20 and further preferably secured to an outside surface of the second pocket 25. The third pocket 28 may be previously apart of the garment 20 or may be separately attached thereto. The third pocket 28 is preferably located adjacent and above the opening 22 leading from the first pocket 21 and directly extending from the face of the second pocket 25.

The third pocket 28 is generally for positioning a heating pad 60 therein during non use of the device 50 to prevent the device 50 from becoming frozen or cold and thus not being able to function properly. The third pocket 28 also generally includes a closure portion 29, such as flap and/or button for closing the third pocket 28 when the heating pad 60 is positioned therein to keep foreign elements away from the heating pad 60 and to prevent the heating pad 60 from falling out of the third pocket 28.

C. Retracting Mechanism

The retracting mechanism 30 is positioned within the first pocket 21 as stated previously. The retracting mechanism 30 is preferably comprised of a stainless-steel material to prevent the retracting mechanism 30 from rusting. Other materials may be appreciated all which preferably allow the retracting mechanism 30 to become wet due to wear in outside elements or washing of the garment 20 while preventing rust thereon.

Various types of retracting mechanisms may be utilized with the present invention. The retracting mechanism 30 is strong enough to retract the elongated member 32 and the device 50 attached to the elongated member 32. The retracting mechanism 30 may retract the device 50 and the elongated member 32 in various manners, such as automatically, through the use of switches, etc. Keeping the device 50 retracted tight against the garment 20 or within the second pocket 25 during use also prevents the devices 50 from dangling against other objects and making noise.

The elongated member 32 is preferably comprised of a flexible cord that can be wound substantially within the retracting mechanism 30 when retracted and pulled therefrom when extended. Various types of strings, ropes, etc. may also be utilized for the elongated member 32. The elongated member 32 is comprised of a suitable length to allow for the user to extend the device 50 far enough away from the garment 20 to utilize the device 50 in a proper manner without having to alter in position or remove the garment 20 or retracting mechanism 30.

D. Retainer

A retainer 40 is generally secured to the second end of the elongated member 32 for removably attaching the device 50 thereto. It is also appreciated that the retainer 40 may be omitted and the second end of the elongated member 32 directly attach to the device 50. The retainer 40 may be comprised of various structures, such as resilient bands, clips, hook and loop members, pins, rings, etc.

E. Device

The device 50 connects to the second end of the elongated member 32 either directly or through the use of the retainer 40. The device 50 is retractable with the elongated member 32. The device 50 may be extended from the retracting mechanism 30 to be directly utilized by the wearer of the garment 20. The device 50 may be retracted towards the garment 20 after use or during non use and positioned within the second pocket 25 or left to retract directly against the opening 22 leading to the first pocket 21.

Figure 2:
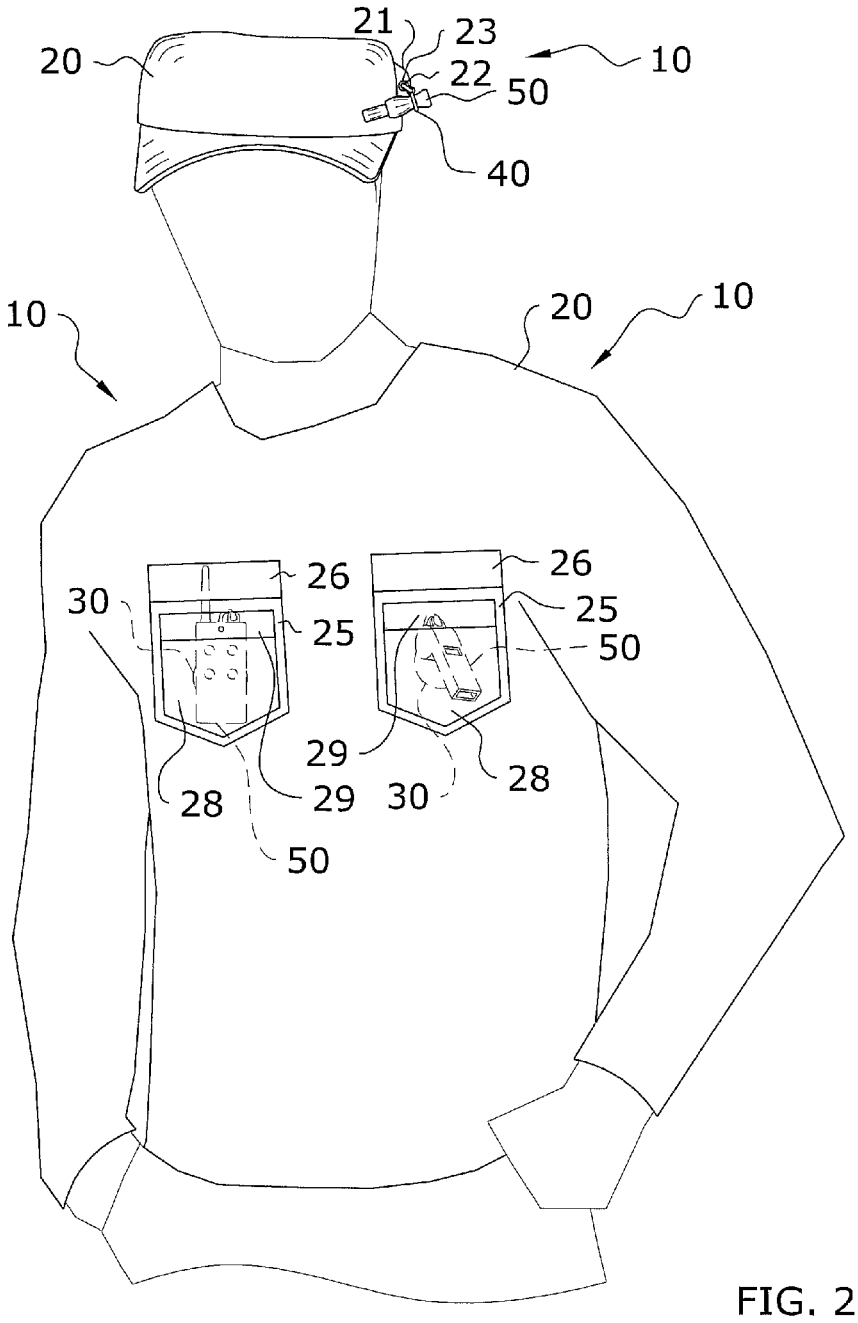
FIG. 2 is the exemplary view of the present invention as illustrated in FIG. 1 except in the retracted position and positioned within respective pockets.
Figure 3:
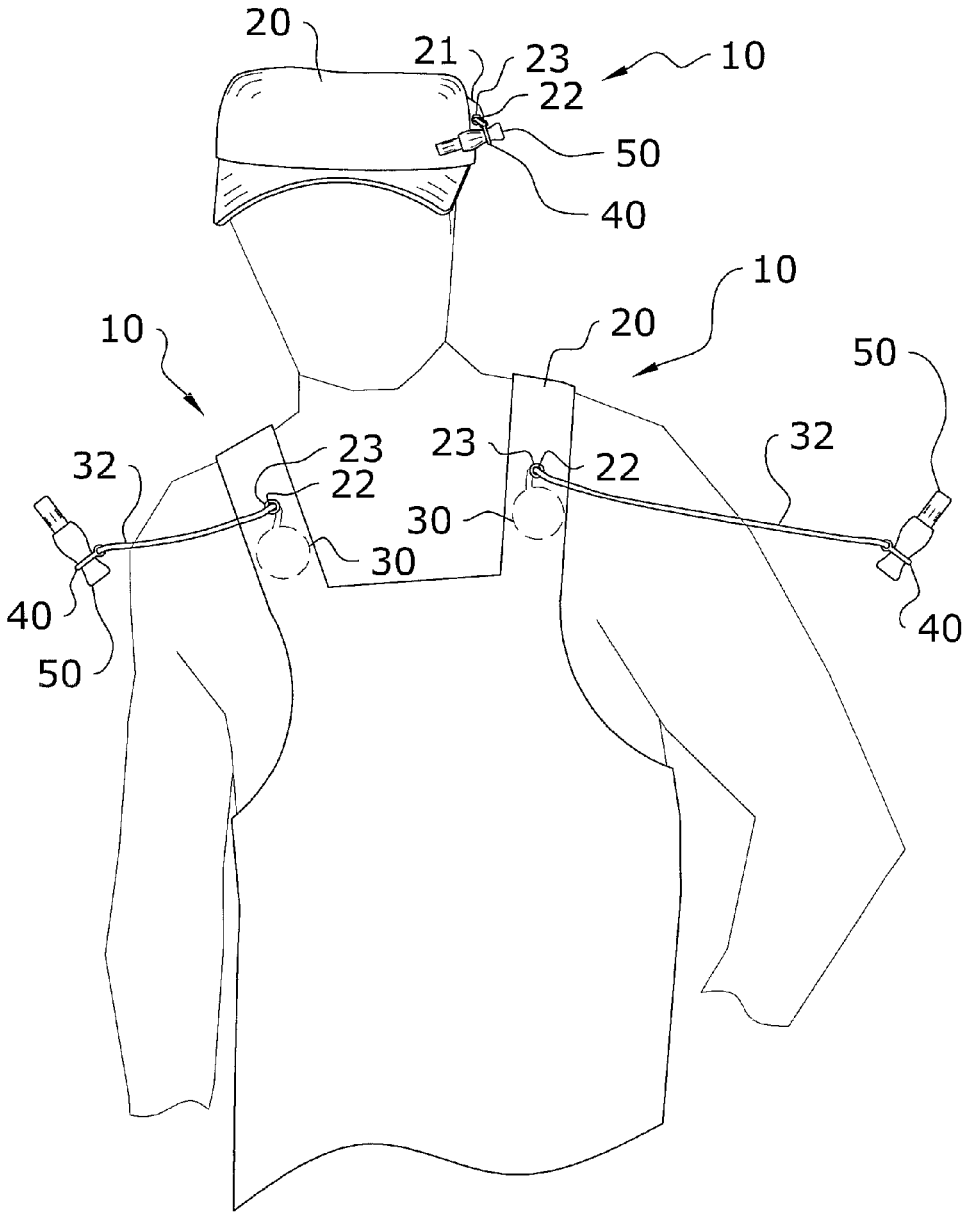
FIG. 3 is another exemplary view of the present invention in the extended position.
Figure 4:
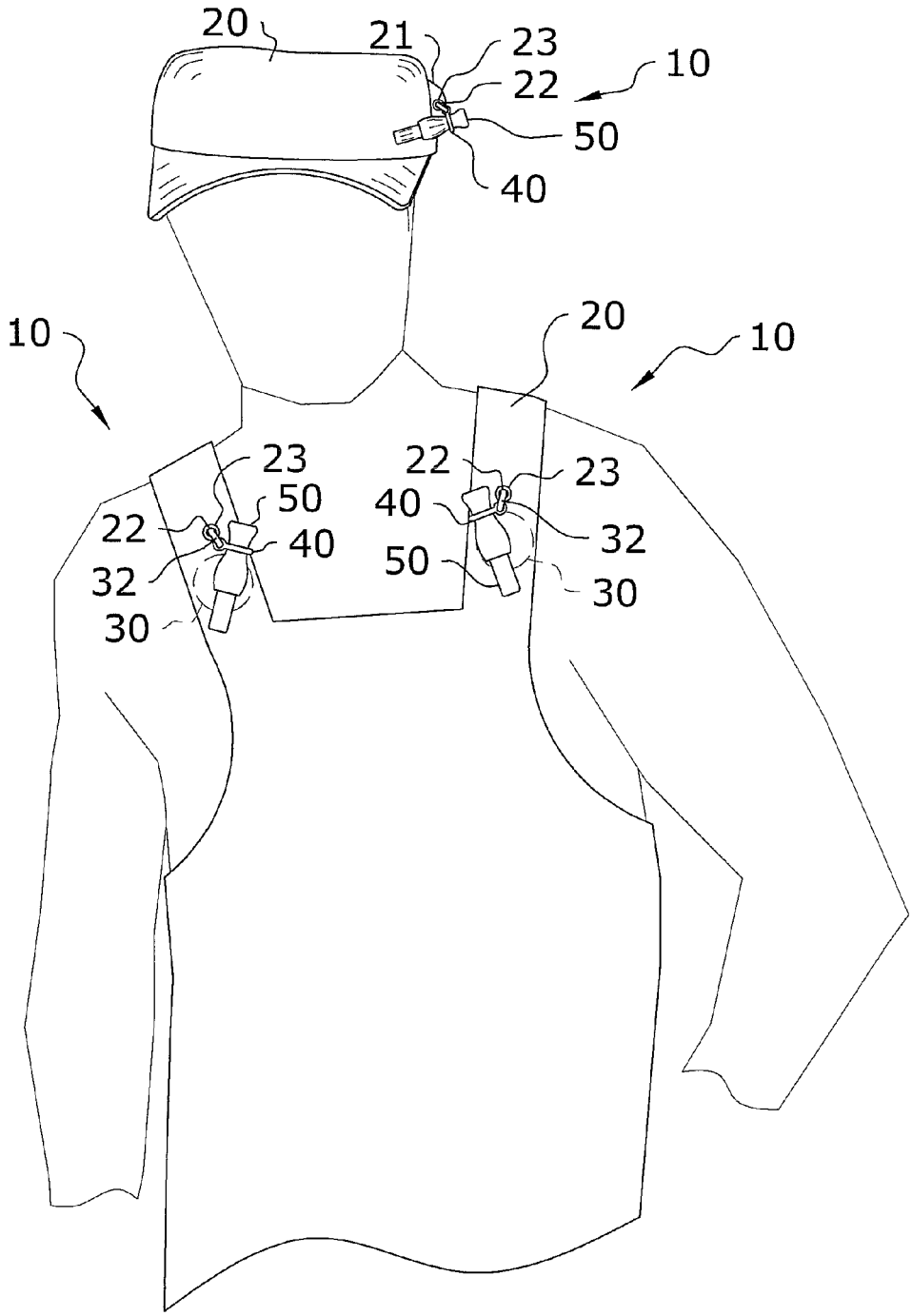
FIG. 4 is the exemplary view of the present invention as illustrated in FIG. 3 except in the retracted position.

Various types of devices may be utilized such as game calls (e.g. bird calls, grunt calls for deer, animal attracting devices, animal repelling devices, etc.), whistles (e.g. dog whistles, etc.), training remotes, protection devices, other electronic devices, other hunting or fishing devices, sharpeners, clippers, lights, work tools, and various other devices that are desired to be readily accessible when hunting, fishing, walking, or in general. It is also appreciated that for multiple devices 50, multiple retracting mechanisms 30 and associated pockets may be utilized, such as illustrated in FIG. 1-4. FIGS. 1 and 2 illustrate a game call, dog whistle, and training remote being each separately attached to a separate elongated member 32 and associated retracting mechanism 30.

F. Heating Pad

The heating pad 60 is generally comprised of a heat pack or other heating mechanism that can be used to heat the device 50 positioned within the second pocket 25 from the third pocket 28 that the heating pad 60 is located.

G. Operation of Preferred Embodiment

In use, the device 50 may be extended from the retracting mechanism 30 to be utilized by the wearer of the garment 20 during use. During non use, the device 50 is simply allowed to retract toward the garment 20 and be retained against thereof or within the second pocket 25 until further use is desired. The heating pad 60 may be activated within the third pocket 28 to keep the device 50 warm within the second pocket 25. It is appreciated that the small size of the opening 22 and the tubular guide 23 prevents the device 50 from being retracted within the first pocket 21.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A garment attachable retention system for a device, comprising:

a garment;

a substantially sealed first pocket secured to said garment;

a retracting mechanism positioned within said first pocket;

wherein said retracting mechanism has an elongated member having a first end connected to said retracting mechanism;

an opening extending through said garment leading to said first pocket, wherein said elongated member extends through said opening; and a device connected to a second end of said elongated member, wherein said device is adapted to retractably extend from said retracting mechanism via said elongated member.

2. The retention system of claim 1, wherein said first pocket is connected to an inside surface of said garment.

3. The retention system of claim 1, wherein said first pocket is connected to an outside surface said garment.

4. The retention system of claim 1, including a second pocket connected to an outside surface of said garment, wherein said second pocket is adapted to receive said device while in a substantially retracted position.

5. The retention system of claim 4, including a third pocket connected to an outside surface of said second pocket.

6. The retention system of claim 5, including a heating pad positioned within said third pocket, wherein said heating pad is adapted to warm said device positioned within said second pocket.

7. The retention system of claim 1, wherein said device is comprised of a game call.

8. The retention system of claim 1, wherein said device is comprised of a dog whistle.

9. The retention system of claim 1, wherein said device is comprised of training remote.

10. The retention system of claim 1, wherein said device is comprised of a light.

11. The retention system of claim 1, wherein said device is comprised of a sharpener.

12. A garment attachable retention system for a device, comprising:

a garment;

a substantially sealed first pocket secured to said garment;

a retracting mechanism positioned within said first pocket;

wherein said retracting mechanism has an elongated member having a first end connected to said retracting mechanism;

a retainer secured to a second end of said elongated member;

a game call connected to said retainer of said elongated member, wherein said game call is adapted to retractably extend from said retracting mechanism via said elongated member;

a second pocket connected to an outside surface of said garment, wherein said second pocket is adapted to receive said device while in a substantially retracted position;

a third pocket connected to an outside surface of said second pocket; and including a heating pad positioned within said third pocket, wherein said heating pad is adapted to warm said device positioned within said second pocket.

13. The retention system of claim 12, wherein said first pocket is sewn to an inside surface of said garment.

14. The retention system of claim 12, wherein said first pocket is sewn to an outside surface said garment.

15. A garment attachable retention system for a device, comprising:

a garment;

a substantially sealed first pocket sewn to said garment;

wherein said first pocket is sewn to an inside surface of said garment;

wherein said garment includes an opening extending therethrough leading to said first pocket;

a tubular guide lining said opening;

a retracting mechanism positioned within said first pocket;

wherein said retracting mechanism has an elongated member having a first end connected to said retracting mechanism;

wherein said elongated member extends through said guide;

a retainer secured to a second end of said elongated member;

a game call connected to said retainer of said elongated member, wherein said game call is adapted to retractably extend from said retracting mechanism via said elongated member;

a second pocket sewn to an outside surface of said garment, wherein said second pocket is adapted to receive said game call while in a substantially retracted position;

wherein said opening extends within said second pocket;

wherein said second pocket includes a closure portion;

a third pocket sewn to an outside surface of said second pocket; and a heating pad positioned within said third pocket, wherein said heating pad is adapted to warm said device positioned within said second pocket;

wherein said third pocket includes a closure portion.

* * * * *